US006382063B1

(12) United States Patent
Guilford

(10) Patent No.: US 6,382,063 B1
(45) Date of Patent: May 7, 2002

(54) WORKPIECE HOLDER FOR CUTTING A 45 DEGREE BEVEL

(76) Inventor: Edwin H. Guilford, 27816 Green Oaks Dr., Eugene, OR (US) 97402

( * ) Notice: Subject to any disclaimer, the term of this patent is extended or adjusted under 35 U.S.C. 154(b) by 0 days.

(21) Appl. No.: 09/759,745

(22) Filed: Jan. 12, 2001

(51) Int. Cl.[7] ..... B26D 7/06
(52) U.S. Cl. ..... 83/435.11; 83/437.1; 83/581
(58) Field of Search ..... 83/437.1, 435.11, 83/435.12, 581, 435.13, 435.14, 452, 464

(56) References Cited

U.S. PATENT DOCUMENTS

| | | | | | |
|---|---|---|---|---|---|
| 1,831,124 | A | * | 11/1931 | Koster | 83/435.12 |
| 2,100,506 | A | * | 11/1937 | Hanlon | 83/581 X |
| 4,002,329 | A | | 1/1977 | Petrowski | |
| 4,164,882 | A | * | 8/1979 | Mericle | 83/435.12 X |
| 4,165,668 | A | | 8/1979 | McCord, Jr. | |
| 4,317,562 | A | | 3/1982 | Thibodaux | |
| 4,367,668 | A | * | 1/1983 | Jensen | 83/435.11 X |
| 4,989,485 | A | | 2/1991 | Roy et al. | |
| 5,823,084 | A | * | 10/1998 | Ramey | 83/435.11 X |
| 5,894,776 | A | * | 4/1999 | Bartz | 83/437.1 X |
| 5,918,520 | A | * | 7/1999 | Whitcomb | 83/435.11 X |
| 5,979,283 | A | | 11/1999 | Osbourne | |

* cited by examiner

*Primary Examiner*—M. Rachuba
*Assistant Examiner*—Jason Prone
(74) *Attorney, Agent, or Firm*—Robert E. Howard

(57) ABSTRACT

A workpiece holder for cutting a 45 degree bevel in a workpiece with a table saw. The holder includes a frame having first and second end plate members that are identical in size and shape and parallel to each other, and a plurality of stabilizer bars extending between and attached to the end plate members. The end plate members are in the shape of right angle triangles having a vertical edge and a horizontal edge having the same length, and an angled edge extending between the vertical and horizontal edges, the angle between the angled edge and the horizontal and vertical edges being 45 degrees. A base plate is attached to the horizontal edges of the end plate members, the base plate having a guide rail extending from its lower planar surface and adapted to engage a guide groove in the table top of a table saw. A table plate is attached to the angled edges of the end plate members. A longitudinal clamping member for securing a workpiece to the table plate is adapted to be positioned parallel to the lower longitudinal edge of the table plate. A lateral clamping member for securing a workpiece to the table plate is adapted to be positioned perpendicular to the lower longitudinal edge of the table plate.

3 Claims, 1 Drawing Sheet

WORKPIECE HOLDER FOR CUTTING A 45 DEGREE BEVEL

BACKGROUND OF THE INVENTION

This invention relates to a workpiece holder for use with a table saw for cutting a 45 degree bevel.

The need to cut a 45 degree bevel between the major planar faces of a piece of wood is a common workshop occurrence. Although many table saws have a tilting arbor which allows adjustment of the table top to the desired bevel angle relative to the cutting blade in order to cut such bevels, such adjustments are time consuming.

SUMMARY OF THE INVENTION

It is an object of the present invention to provide a workpiece holder which allows a 45 degree bevel to be cut through the workpiece with a table saw while leaving the saw blade at a true 90 degree angle with the saw table.

This and other objects are achieved by providing a workpiece holder, hereinafter sometimes referred to as a "sled", which holds a workpiece at a 45 degree angle to the blade of a table saw.

The sled has a base plate whose lower planar surface is adapted to rest against the upper planar surface of the table of a table saw.

A longitudinally extending guide rail extends from the lower planar surface of the base plate and is adapted to ride in a guide groove typically located in the upper planar surface of the table of a table saw.

A table plate is held at a 45 degree angle relative to the base plate by an attachment framework comprised of spaced apart end plate members held in place by a single top cross member and two bottom cross members ("stabilizers") connected thereto.

A longitudinal clamping member is adapted to hold an elongated piece of wood or plywood therein for cutting a bevel along the lower longitudinal edge thereof. A lateral clamping member is adapted to hold an elongated piece of wood or plywood therein for cutting a bevel along the lower end thereof.

DESCRIPTION OF PREFERRED EMBODIMENTS

Figure 1:
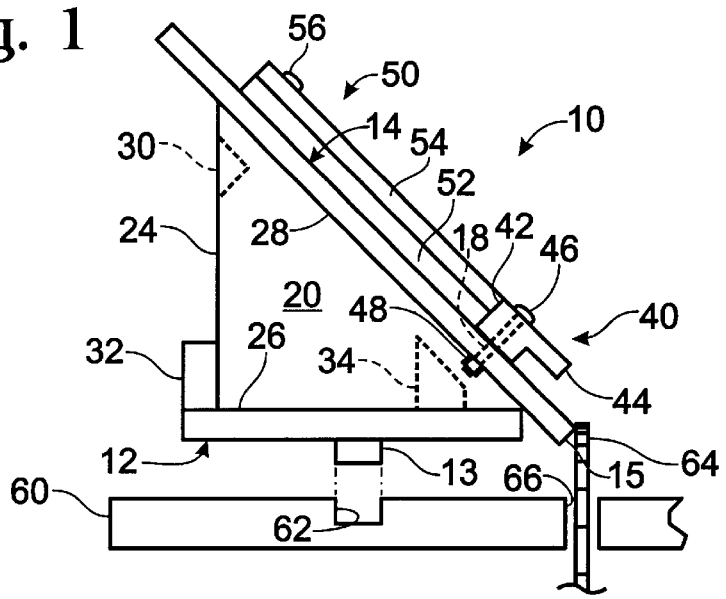
FIG. 1 is a front, elevation view of the sled of the present invention shown in aligned relationship to a partial view of the table and blade of a table saw.

The sled 10 of the present invention has a base plate 12 land a table plate 14. The major plane of the table plate 14 is at a 45 degree angle to the major plane of the base plate 12. A longitudinal guide rail 13 extends from the lower planar surface of base plate 12.

Base plate 12 and table plate 14 are attached to a frame. The frame includes first and second vertical end plate members 20. End plates 20 are identical in size and shape and are parallel to each other. Each end plate is in the shape of a right angle triangle with a vertical edge 24, a horizontal edge 26 and an angled edge 28 extending between the outer ends of vertical edge 24 and horizontal edge 26. The angle between horizontal edge 26 and angled edge 28 is 45 degrees.

A plurality of stabilizer bars extend between end plates 20, including upper stabilizer bar 30, lower stabilizer bar 32, and inner stabilizer bar 34. Stabilizer bars 30, 32, and 34 are attached to end plates 20 in any suitable manner, such as by use of screws, and are adapted to rigidly hold end plates 20 parallel to each other in a vertical position, as shown.

Base plate 12 is attached to the outer surfaces of horizontal edges 26 of end plates 20. The base plate 12 has a width that is substantially the length of horizontal edges 26, extending rearwardly of vertical edges 24 a short distance sufficient to accommodate stabilizer bar 32.

Table plate 14 is attached to the outer surfaces of angled edges 28 of end plates 20. The lower longitudinal edge 15 of table plate 14 is in the.same plane as the lower planar surface of base plate 12 so that, in operation, lower edge 15 meets the upper planar surface of table 60 at the edge of saw blade 64.

The attachment of the base plate 12 and table plate 14 to end plates 20 can be by any suitable means, such as by use of screws.

A longitudinal clamping member 40 is positioned adjacent the lower longitudinal edge 15 of table plate 14. Clamping member 40 includes a vertical arm 42 and a horizontal arm 44. The inner surface of vertical arm 42 is parallel to the lower longitudinal edge 15 of table plate 14. The lower edge of vertical arm 42 abuts the upper planar surface of table plate 14. Bolts 46 pass through openings in vertical arm 42 and aligned openings 18 in table plate 14. Bolts 46 are screwed into nuts 48 (preferably T-nuts) to attach clamping member 40 to table plate 14.

The space formed by the lower surface of horizontal arm 44, the upper planar surface of table plate 14, and the inner face of vertical arm 42 extending therebetween provides a seat for the inner longitudinal edge of a workpiece whose opposing, parallel outer longitudinal edge is to be beveled. The inner face of vertical arm 42 is parallel to the lower longitudinal edge 15 of table plate 14 and is, therefore, parallel to rail 13. The inner longitudinal edge of the workpiece is either placed in abutment against the inner face of vertical arm 42 or at some intermediate location, in either case with its outer longitudinal edge in alignment with lower longitudinal edge 15 of table plate 14. The workpiece is firmly held in place by tightening bolts 46.

Figure 2:
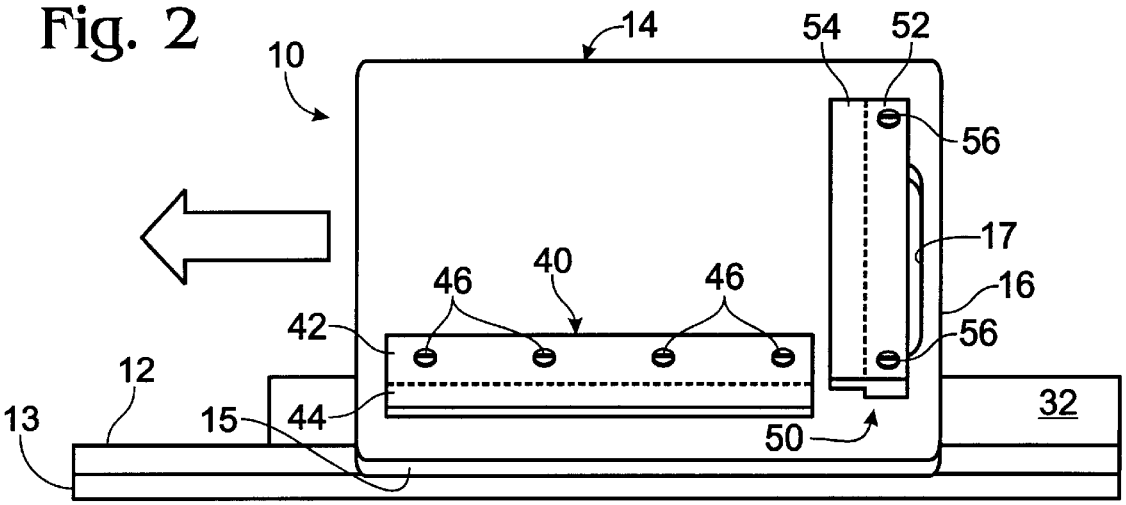
FIG. 2 is a top, plan view of the table plate and clamping members of the sled of the present invention.
Figure 3:
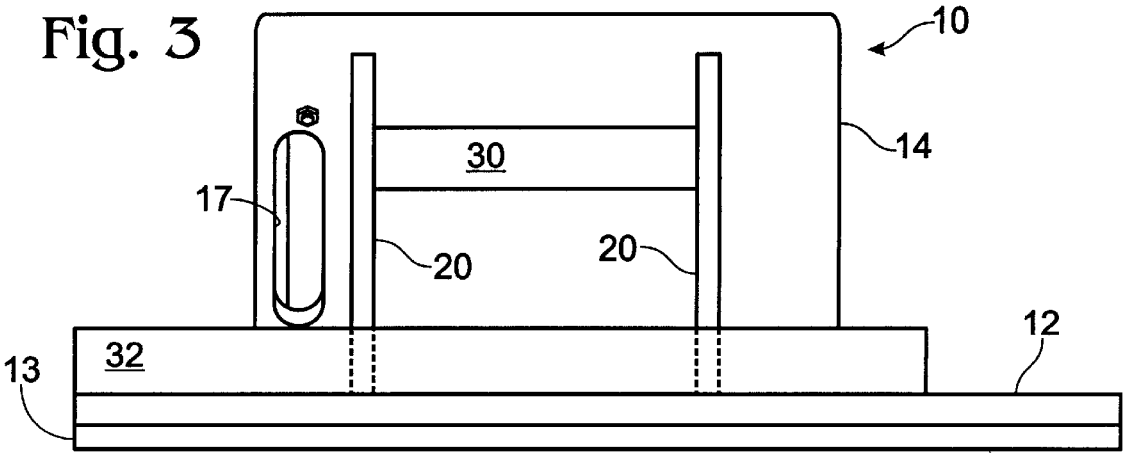
FIG. 3 is a side, elevation view of the back side of the sled of the present invention.

A lateral clamping member 50 is adapted to be positioned adjacent the trailing end 16 of table plate 14, the direction of travel of table plate 14 during cutting being indicated by the arrow in FIG. 2. Lateral clamping member 50 is similar in cross-section to longitudinal clamping member 40, and includes a vertical leg 52 and a horizontal leg 54. Vertical leg 52 is perpendicular to lower longitudinal edge 15 of table plate 14. Lateral clamping member 50 is secured to table plate 14 by bolts 56 (which pass through openings in vertical leg 52 and stable plate 14) screwed into nuts (not shown), preferably T-nuts. The space between the lower surface of horizontal arm 54, the upper planar surface of table plate 14 and the inner surface of vertical leg 52 provides a seat for a workpiece whose lower lateral edge is to be beveled. The inner longitudinal edge of the workpiece is placed in abutment with the inner surface of vertical leg 52, the lower lateral edge being in alignment with the lower longitudinal edge 15 of table plate 14. The workpiece is firmly held in place by tightening bolts 56 into the T-nuts.

An opening 17 in the trailing end 16 of table plate 14 provides a handle for the operator to push the sled across the upper planar surface of a table saw during use, and allows the sled 10 to be easily carried when not in use.

In operation, a workpiece (typically a piece of hardwood) is secured to the sled by one of the clamping members 40 or 50. The clamping member 40 or 50 not selected for use may be removed from table plate 14 if it is in the way. The longitudinal edge or lateral edge of the workpiece that is to be beveled is placed into alignment with the lower longitudinal edge 15 of table plate 14.

If it is desired to cut a bevel along a longitudinal edge of the workpiece, the workpiece is secured to table plate 14 by longitudinal clamping member 40. If it is desired to cut a bevel along a lateral edge of the workpiece, the workpiece is secured to table plate 14 by lateral clamping member 50. In either case, the workpiece is attached so that the edge to be beveled meets squarely with the bottom edge of table plate 14.

After the workpiece is secured, sled 10 is placed on the upper planar surface of table 60 of a table saw with guide rail 13 riding in guide groove 62 thereof and the lower planar surface of base plate 12 in contact with the upper planar surface of table 60. The saw blade 64 of the table saw extends through an opening 66 of table 60 and is set at 90 degrees to the major plane of the saw table 60. As sled 10 is pushed across table 60 (in the direction of the arrow in FIG. 2), guided by guide rail 13 riding in groove 62, the lower edge of the workpiece contacts saw blade 64 and a 45 degree bevel is cut in that edge.

Although the saw blade 64 is illustrated in FIG. 1 as extending a distance above the upper planar surface of table 60 that would cut through the workpiece in one pass, it may be desirable for thicker workpieces to lower the saw blade 64 during the initial pass and raise it during subsequent passes to minimize wear and overheating of the blade.

The distance between the upper planar surface of table plate 14 and the lower surfaces of the horizontal arms 44 and 54 of clamp members 40 and 50, respectively, may not be the exact thickness of a particular workpiece. If additional height is required, shims can be placed beneath the inner edges of vertical arms 42 or 52 that are in abutment with the upper planar surface of table plate 14. If less height is required, shims can be placed between the lower surface of the horizontal arms 44 or 54 of clamping member 40 or 50, respectively, and the workpiece.

It is clear that the size of table plate 14 and the location of clamping members 40 and 50 thereon are selected to accommodate the size of the workpieces to be beveled.

It will be obvious to those having skill in the art that changes may be made to the details of the embodiments of the described invention without departing from the underlying principles thereof. The scope of the present invention should, therefore, be determined only by the following claims.

The invention claimed is:

1. A workpiece holder for positioning a workpiece for a bevel cut by the saw blade of a table saw comprising:

a frame including first and second vertically disposed end plate members and a plurality of stabilizer bars extending between said end plate members and attached thereto; said first and second end plate members being identical in size and shape and parallel to each other, the shape of each said end plate member being a right angle triangle having a vertical edge and a horizontal edge of equal length, and an angled edge extending between said vertical and horizontal edges, said angled edge being at a 45 degree angle to said vertical edge and said horizontal edge;

a base plate having opposed upper and lower planar surfaces, said base plate being attached to the horizontal edges of said end plate members, said base plate having a longitudinal guide rail extending from said lower planar surface, said guide rail being adapted to slidably engage a guide groove located in a table saw top;

a table plate having opposed upper and lower planar surfaces, upper and lower longitudinal edges, a leading edge and a trailing edge, said table plate being attached to the angled edges of said end plate members, said lower longitudinal edge of said table plate being adapted to meet said table saw top at the edge of said saw blade when said guide rail is engaged in said guide groove of said table saw top; and a workpiece clamp member attached to said upper planar surface of said table plate and adapted to hold a workpiece with that edge of the workpiece to be beveled in alignment with said lower longitudinal edge of said tale plate.

2. The workpiece holder of claim 1 wherein said workpiece clamp member is a longitudinal workpiece clamp member attached to said table plate parallel to the lower longitudinal edge thereof.

3. The workpiece holder of claim 1 wherein said workpiece clamp member is a lateral workpiece clamp member attached to said table plate perpendicular to the lower longitudinal edge thereof.

* * * * *